US010563344B2

(12) United States Patent
Mazière et al.

(10) Patent No.: US 10,563,344 B2
(45) Date of Patent: Feb. 18, 2020

(54) IRONING MACHINE

(71) Applicant: ELECTROLUX LAUNDRY SYSTEMS FRANCE SNC, Rosieres (FR)

(72) Inventors: André Mazière, Rosieres (FR); Oscar Mayeur, Rosieres (FR)

(73) Assignee: Electrolux Laundry Systems France SNC, Rosieres (FR)

( * ) Notice: Subject to any disclaimer, the term of this patent is extended or adjusted under 35 U.S.C. 154(b) by 84 days.

(21) Appl. No.: 15/775,531

(22) PCT Filed: Nov. 25, 2015

(86) PCT No.: PCT/EP2015/077664
§ 371 (c)(1),
(2) Date: May 11, 2018

(87) PCT Pub. No.: WO2017/088916
PCT Pub. Date: Jun. 1, 2017

(65) Prior Publication Data
US 2018/0327960 A1 Nov. 15, 2018

(51) Int. Cl.
*D06F 67/02* (2006.01)
*D06F 65/02* (2006.01)
*H05B 1/02* (2006.01)

(52) U.S. Cl.
CPC ..... *D06F 67/02* (2013.01); *D06F 65/02* (2013.01); *D06F 2202/04* (2013.01);
(Continued)

(58) Field of Classification Search
CPC ..... D06F 67/00; D06F 67/02; D06F 67/08; D06F 67/10; D06F 65/00–10;
(Continued)

(56) References Cited

U.S. PATENT DOCUMENTS 4,425,489 A * 1/1984 Pav ..... F26B 13/183 100/330
4,562,655 A * 1/1986 Bosshart ..... D06F 65/02 100/157
(Continued)

FOREIGN PATENT DOCUMENTS

EP 1403417 3/2004
EP 1413665 4/2004
(Continued)

OTHER PUBLICATIONS

International Search Report for PCT/EP2015/077664, dated Mar. 30, 2016, 2 pages.

*Primary Examiner* — Ismael Izaguirre
(74) *Attorney, Agent, or Firm* — Pearne & Gordon LLP

(57) ABSTRACT

An ironing machine (1), such as a cylinder ironer, is provided. The ironing machine (1) comprises a cylindrical body (3) having heating means (5) for heating of the cylindrical body (3) and at least one temperature sensor arrangement (7), arranged to be in contact with the cylindrical body (3) and to detect a temperature of the cylindrical body (3). The at least one temperature sensor arrangement (7) and the cylindrical body (3) are at least partly made of electrically conductive material. The ironing machine (1) comprises an electrical control system (9) configured to detect a degree of contact between the cylindrical body (3) and the at least one temperature sensor arrangement (7) by means of electricity, and generate a control signal indicative of the detected degree of contact.

15 Claims, 4 Drawing Sheets

(52) U.S. Cl.
CPC ..... *D06F 2212/02* (2013.01); *H05B 1/0272* (2013.01); *H05B 1/0291* (2013.01)

(58) Field of Classification Search
CPC ..... D06F 2202/00; D06F 2202/04; D06F 2202/12; D06F 2212/02; H05B 1/0272; H05B 1/0291
See application file for complete search history.

(56) References Cited

U.S. PATENT DOCUMENTS

| | | | | | |
|---|---|---|---|---|---|
| 4,594,068 | A * | 6/1986 | Bardutzky | G03G 15/206 | 219/216 |
| 5,281,793 | A * | 1/1994 | Gavin | G03G 15/2039 | 219/216 |
| 5,551,175 | A | 9/1996 | Neyman | | |
| 5,557,385 | A * | 9/1996 | Tanaka | G03G 15/2003 | 219/216 |
| 6,198,901 | B1 * | 3/2001 | Watanabe | G03G 15/2053 | 399/328 |

FOREIGN PATENT DOCUMENTS

| | | | |
|---|---|---|---|
| JP | 2010091310 | A * | 4/2010 |
| JP | 2012168320 | A * | 9/2012 |
| WO | WO 2012043423 | A1 * | 4/2012 |

* cited by examiner

IRONING MACHINE

TECHNICAL FIELD

Embodiments herein relate to an ironing machine, in particular to a cylinder ironer for ironing and/or drying of sheets, towels and other items.

BACKGROUND

Ironing machines, which also may be referred to as cylinder ironers or chest ironers, are commonly used for drying and ironing of sheets, towels and other items with relatively large surfaces. Ironing machines are foremost used in various professional applications, such as in hotels, laundries etc.

An ironing machine may comprise a cylinder, e.g. made of metal. The cylinder is rotatable around an axis of rotation via rotation means. The cylinder can also comprise heating means which can heat a periphery of the cylinder.

The ironing machine may further comprise ironing strips or similar. Such ironing strips can be arranged to press against the heated periphery of the cylinder and rotate with it. Items to be ironed and/or dried are fed in between the convex cylinder and concavely shaped ironing strips by the rotating movement of the cylinder.

When the item to be ironed follows the rotating movement of the cylinder, one side of the item is facing the ironing strips and the other side of the item is facing the cylinder. The ironing strips and the cylinder may be pushed together such that the item is pressed and retained between the ironing strips and the cylinder until the entire item has passed through a passage between the ironing strip and the cylinder.

Some cylinder ironers comprise a chest instead of ironing strips. Such chest can be made of metal and may comprise a concave side arranged to face the cylinder.

During passage between the cylinder and ironing strips the item is both dried and ironed due to the friction against the ironing strips/cylinder and due to the temperature of the cylinder. The temperature of the heated cylinder is normally about 200 degrees Celsius before the cylinder is used for ironing and/or drying of items.

The cylinder may be heated e.g. by electric elements arranged inside the cylinder, by a gas burner or by circulation of hot steam or fluid within channels of the cylinder.

A temperature of the cylinder may be controlled via a sensor. For example, EP1413665A1 discloses an ironing machine in which a controller can control operating parameters based on input from a sensor arranged to detect a temperature of a cylinder.

Known ironing machines, such as the ironing machine disclosed in EP1413665A1, may be suitable in some applications. However, there remains a need for an ironing machine which is reliable and efficient with regards to temperature control, safety and maintenance.

SUMMARY

An object is to provide an ironing machine which is reliable and efficient with regards to temperature control, safety and maintenance.

According to an embodiment, the object is achieved by an ironing machine, such as a cylinder ironer, comprising a cylindrical body which comprises heating means for heating of the cylindrical body and at least one temperature sensor arrangement, arranged to be in contact with the cylindrical body and to detect a temperature of the cylindrical body, wherein the at least one temperature sensor arrangement and the cylindrical body are at least partly made of electrically conductive material, and in that the ironing machine comprises an electrical control system configured to; detect a degree of contact between the cylindrical body and the at least one temperature sensor arrangement by means of electricity, and generate a control signal indicative of the detected degree of contact.

Several different conditions may influence the degree of contact between the cylindrical body and the at least one temperature sensor arrangement. For example, a defective or intermittent contact may be caused by textile, fluff or similar jammed between the cylindrical body and the temperature sensor arrangement. A damaged or bent holder/attachment organ for the temperature sensor arrangement may cause a reduced degree of contact. The degree of contact may also be affected of wear of the temperature sensor arrangement. The degree of contact between the cylindrical body and the at least one temperature sensor arrangement may also be defective due to erroneous mounting/adjustments/settings of any parts of the ironing machine.

A defective or intermittent contact may cause the temperature sensor arrangement to detect a temperature which differs from the actual temperature of the cylindrical body, wherefore heating means may not be able to heat the cylindrical body as intended.

Since the electrical control system according to embodiments herein is configured to detect a degree of contact between the cylindrical body and the at least one temperature sensor arrangement by means of electricity and to generate a control signal indicative of the detected degree of contact, a defective or intermittent contact between the cylindrical body and the temperature sensor arrangement can be detected immediately. Hereby both safety and reliability is enhanced since excessive heating of the cylindrical body is avoided. Further, since a control signal indicative of the detected degree of contact is generated, maintenance of the ironing machine can be performed more efficiently.

Thus, hereby an ironing machine which is reliable and efficient with regards to temperature control, safety and maintenance is provided.

According to some embodiments the electrical control system is arranged to supply an electrical current between the at least one temperature sensor arrangement and the cylindrical body, thereby providing the electricity by means of which the degree of contact is detectable, and detect the degree of contact between the at least one temperature sensor arrangement and the cylindrical body by measurement of the electrical current.

Supply and measurement of an electrical current has proven to be efficient and reliable for detection of the degree of contact between the at least one temperature sensor arrangement and the cylindrical body.

According to some embodiments the electrical control system is arranged to feed the electrical current into an electric circuit formed by the at least one temperature sensor arrangement and the cylindrical body, and detect the degree of contact between the at least one temperature sensor arrangement and the cylindrical body by measurement of the electrical impedance. Measurement of the electrical impedance in the electrical circuit formed by the at least one temperature sensor arrangement and the cylindrical body provides for efficient and reliable detection of the degree of contact. The electrical circuit may comprise other parts and features than the temperature sensor arrangement and the cylindrical body, such as electrical cables, conductors etc.

The electric circuit can be an alternating current electrical circuit or a direct current electrical circuit, in which case the impedance would be the same as the resistance According to some embodiments the temperature sensor arrangement comprises a first electrically conductive friction shoe. Such first electrically conductive friction shoe is arranged to abut the cylindrical body and allows a non-rotating temperature sensor to continuously detect a temperature of the rotating cylindrical body.

According to some embodiments the electrical control system comprises a plurality of first electrically conductive friction shoes, one or more second electrically conductive friction shoes and in that the electrical control system is arranged to; supply an electrical current through one or more electric circuits formed by the first electrically conductive friction shoes, the one or more second electrically conductive friction shoes and the cylindrical body, detect an electrical impedance in said electrical circuit, and generate a control signal indicative of the detected impedance. With a plurality of first electrically conductive friction shoes arranged to be in contact with the cylindrical body, temperatures of the cylindrical body can be detected for a plurality of different positions.

According to some embodiments the electrical control system comprises a plurality of sub-circuits, each sub-circuit comprising a first electrically conductive friction shoe, a second electrically conductive friction shoe and detection arrangements, and in that the electrical control system is arranged to; supply an electrical current through the cylindrical body and each sub-circuit, detect, by the respective detection arrangements, an electrical impedance in each sub-circuit, and generate a control signal indicative of the detected impedance in each sub-circuit. Hereby temperatures of the cylindrical body can be efficiently detected for a plurality of different positions.

According to some embodiments the first and second friction shoes are arranged to be in contact with a peripheral surface of the cylindrical body. Hereby a temperature of the peripheral surface can be efficiently detected.

According to some embodiments the first and second friction shoes are distributed along a longitudinal direction of the cylindrical body. Since the first and second friction shoes are distributed along a longitudinal direction of the cylindrical body temperatures at different cylindrical body positions can be accurately detected.

According to some embodiments the ironing machine comprises one or more resilient members arranged to bias at least one of the first and second friction shoes towards the cylindrical body. Hereby the first and second friction shoes are biased against the cylindrical body during the rotation of the cylindrical body during normal operation.

According to some embodiments the electric control system is configured to set a level of heating for the heating means based on the control signal. A temperature of the cylindrical body can hereby be controlled at least partly based on the control signal received from the electric control system.

According to some embodiments the electric control system is arranged to deactivate the heating means when the impedance exceeds a deactivation threshold value. Hereby heating of the cylindrical body can be paused or stopped, e.g. if the impedance is high due to a defective contact between the cylindrical body and the temperature sensor arrangement.

According to some embodiments the ironing machine comprises an alert system, and wherein the electric control system is arranged to activate the alert system when the impedance exceeds an alert threshold value. An ironing machine operator or service technician can hereby quickly be informed or warned if the impedance is high due to a defective contact between the cylindrical body and the temperature sensor arrangement.

According to some embodiments the ironing machine comprises a low voltage supply system, arranged to be connected to the electrical control system. Hereby an electrical current can be fed into electrical circuits according to embodiments described herein in a self-contained manner.

According to some embodiments the electrical control system is arranged to feed the electrical current into a direct current electric circuit formed by the at least one temperature sensor arrangement and the cylindrical body and to detect the degree of contact between the at least one temperature sensor arrangement and the cylindrical body by measurement of the electrical resistance in the direct current electrical circuit. Measurement of the electrical resistance in the direct current electrical circuit formed by the at least one temperature sensor arrangement and the cylindrical body provides for efficient and reliable detection of the degree of contact.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings, in which embodiments are shown. Well-known functions or constructions will not necessarily be described in detail for brevity and/or clarity.

Figure 1:
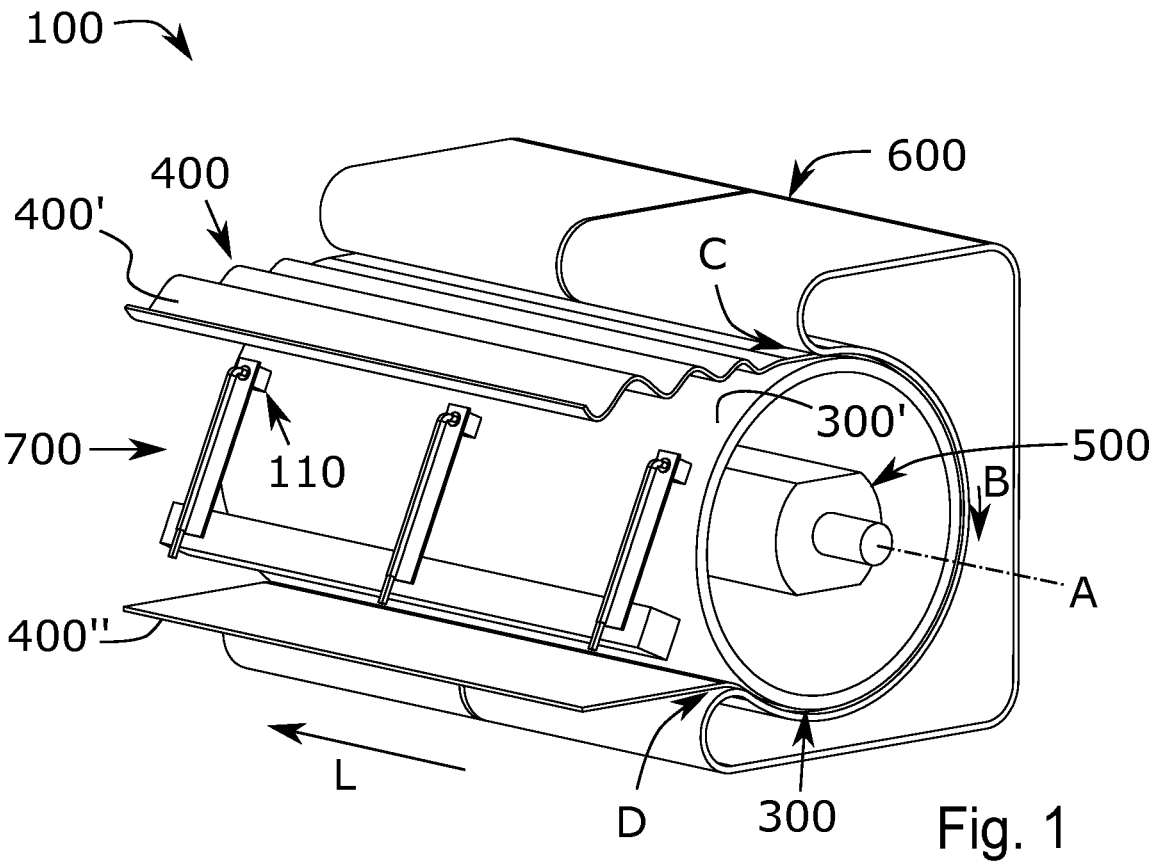
FIG. 1 illustrates a perspective view of an ironing machine according to the prior art.

FIG. 1 illustrates an ironing machine 100 according to the state of the art. The ironing machine 100 comprises a cylindrical body 300 with a peripheral surface 300'. The ironing machine also comprises heating means 500. The heating means 500 can for example comprise electric elements arranged within walls of the cylindrical body 300. In some embodiments the heating means comprises a gas burner, hot steam generator or similar, such that the cylindrical body can be heated by the gas burner or by circulation of hot steam or fluid within channels of the cylindrical body.

The ironing machine 100 illustrated in FIG. 1 further comprise ironing strips 600. Such ironing strips 600 can be arranged to be pressed against the heated peripheral surface 300' of the cylindrical body 300 as known in the art. The ironing strips 600 can be pressed against the cylinder body 300 and kept in place e.g. with cylinders (not shown) which extends substantially in parallel with the cylindrical body 300.

Items 400 to be ironed and/or dried are fed in between the convex cylindrical body 300 and the concave ironing strips 600 by the rotating movement of the cylindrical body 300.

The ironing machine 100 further comprises means (not shown) for rotating the cylindrical body 300 around an axis A of rotation. The axis A of rotation may also be referred to as a center axis of the cylindrical body 300. When the cylindrical body 300 is rotated, a user may arrange the item 400 to be ironed and/or dried on the cylindrical body 300. When the cylindrical body 300 is rotated in a direction B it brings, by friction, the item 400 to be fed in between the ironing strips 600 and the cylindrical body 300.

When a wet/untreated item 400' passes from intake C to exit D, it is pressed, ironed and/or dried. The thus treated item is indicated 400" in FIG. 1.

During passage between the cylindrical body 300 and the ironing strips 600, the item 400 is both dried and ironed due to friction and a temperature of the heated cylindrical body 300. The temperature of the heated cylindrical body 300 is normally about 200 degrees Celsius. In FIG. 1 also a longitudinal direction L of the cylindrical body 300 is illustrated.

The ironing machine 100 further comprises a temperature sensor arrangement 700. The temperature sensor arrangement 700 comprises one or more temperature sensors arranged as friction shoes 110.

Figure 2:
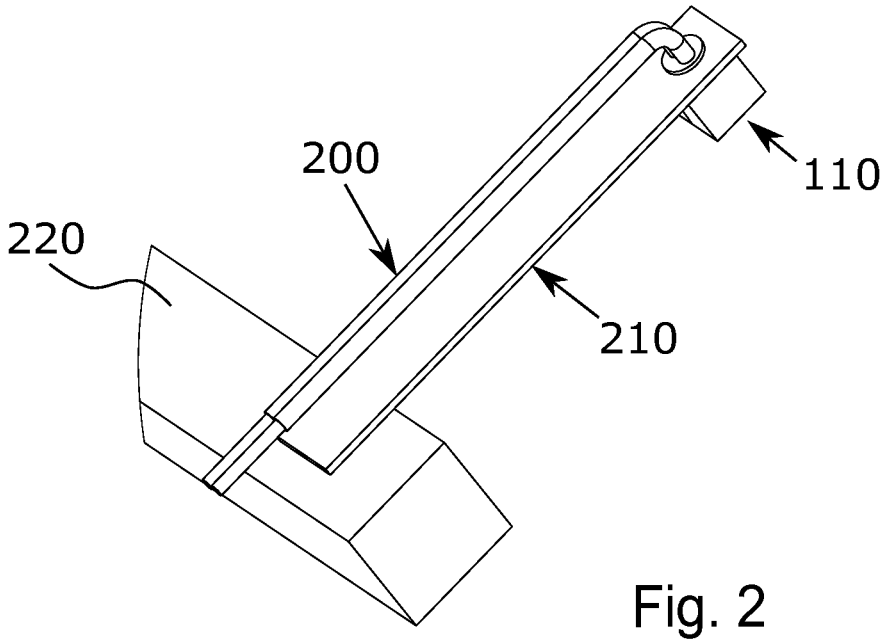
FIG. 2 illustrates some details of the FIG. 1 ironing machine.

FIG. 2 illustrates the temperature sensor arrangement 700 and a friction shoe 110. The friction shoes 110 can be connected to a control arrangement (not shown) via control connection cables 200. When a sufficient temperature of the cylindrical body is detected the control arrangement can deactivate heating means of the ironing machine. The friction shoe illustrated in FIG. 2 is attached to a bar 220 via an arm 210. As illustrated in FIG. 1, the bar can extend substantially in parallel with the axis A of rotation.

Figure 3A:
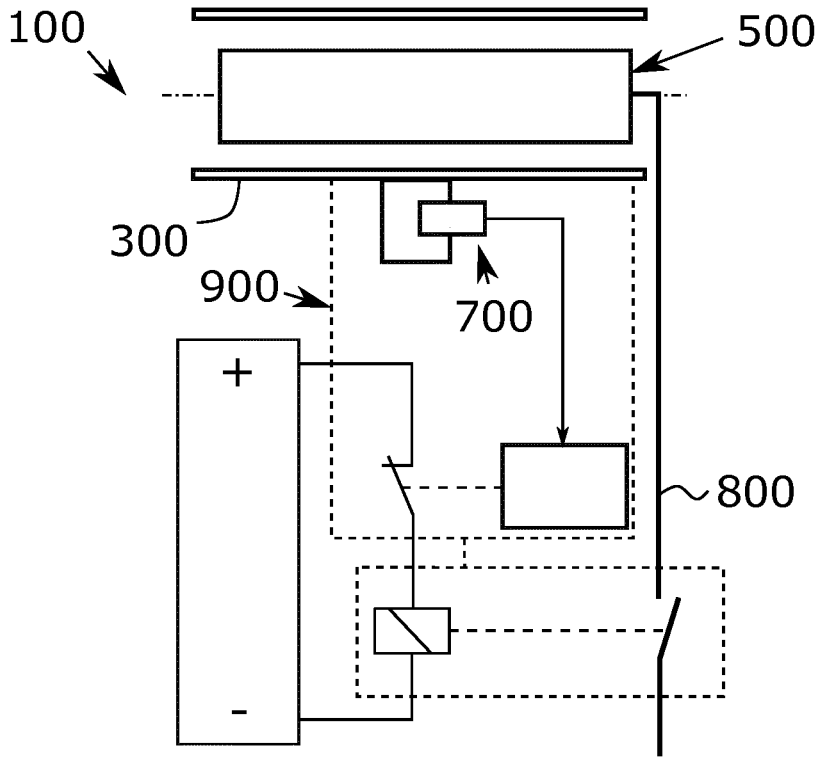
FIG. 3*a* illustrates a schematic view of an ironing machine according to the prior art.
Figure 3B:
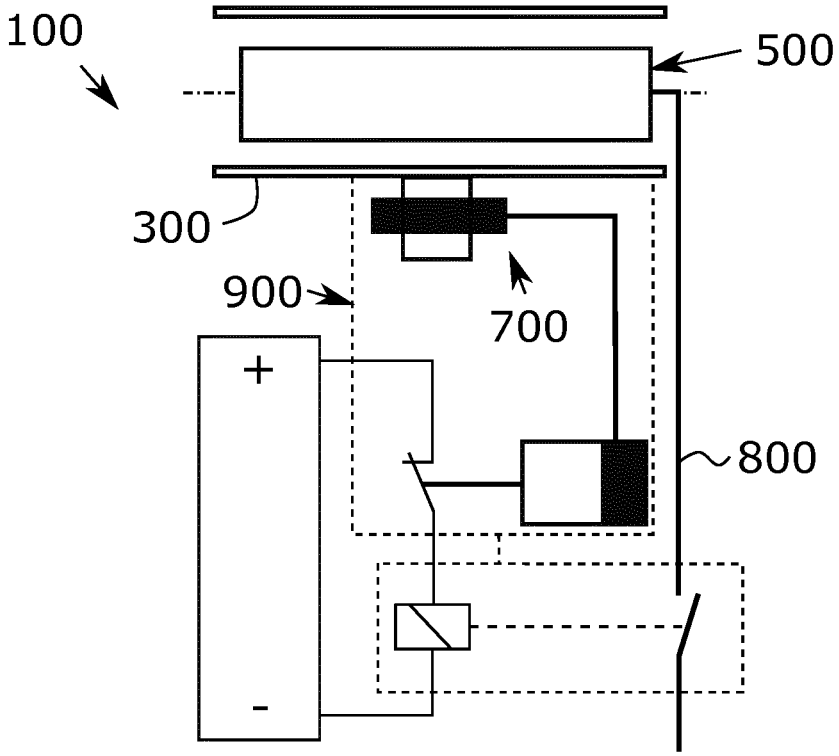
FIG. 3*b* illustrates a schematic view of a further ironing machine according to the prior art.

In FIGS. 3*a* and 3*b* an ironing machine 100 according to the state of the art is illustrated schematically. In FIG. 3*a* the temperature sensor arrangement 700 comprises bi-metal-blades. In FIG. 3*b* the temperature sensor arrangement 700 comprises a liquid expansion bulb arrangement. Information on a detected temperature of the cylindrical body 300 is supplied to a control arrangement 900. The control arrangement 900 can e.g. connect or disconnect a heating means electric supply 800. In FIGS. 3*a* and 3*b* the electricity to the heating means 500 is cut off.

Figure 4A:
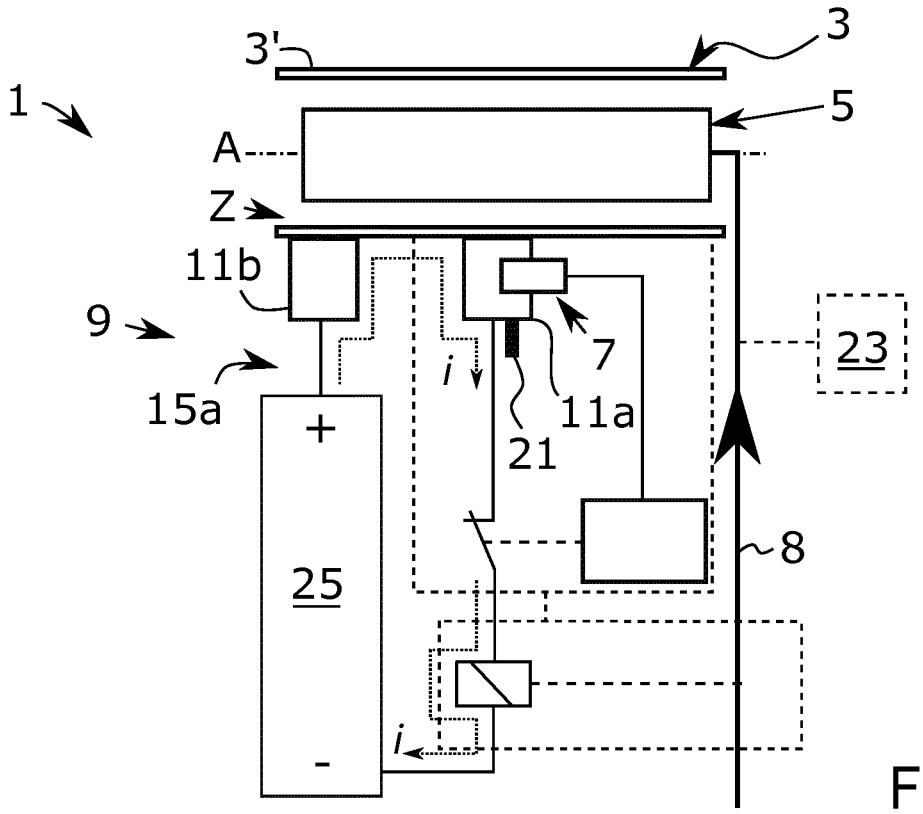
FIGS. 4*a* and 4*b* illustrate schematic views of an ironing machine according to some embodiments herein.

FIG. 4*a* schematically illustrates an ironing machine 1 according to some embodiments herein. The ironing machine 1 can also be referred to as a cylinder ironer. The ironing machine 1 comprises a cylindrical body 3. The cylindrical body 3 is at least partly made of electrically conductive material, such as metal.

The ironing machine 1 also comprises heating means 5 for heating of the cylindrical body 3 and at least one temperature sensor arrangement 7. The temperature sensor arrangement 7 is arranged to be in contact with the cylindrical body 3 during normal operation of the ironing machine, i.e. when the cylindrical body 3 is brought to rotate around the axis A of rotation. The temperature sensor arrangement 7 is arranged to detect a temperature of the cylindrical body 3, or more precisely, a peripheral surface 3' of the cylindrical body 3. The at least one temperature sensor arrangement 7 is at least partly made of electrically conductive material, such as metal.

The ironing machine 1 further comprises an electrical control system 9. The electrical control system 9 is configured to detect a degree of contact between the cylindrical body 3 and the at least one temperature sensor arrangement 7 by means of electricity. The electrical control system 9 is arranged to detect if the at least one temperature sensor arrangement 7 is in good enough contact or not with the cylindrical body 3. The electrical control system 9 can detect e.g. if the at least one temperature sensor arrangement 7 is in continuous contact with the cylindrical body 3 or if the contact is intermittent. The electrical control system can detect if a contact surface is small or large, i.e. to what extent there is contact between the at least one temperature sensor arrangement 7 and the cylindrical body 3.

The electrical control system 9 is arranged to generate a control signal indicative of the detected degree of contact. In some embodiments the electric control system 9 is configured to set a level of heating for the heating means 5 based on the control signal. In the embodiment illustrated in FIG. 4*a* the at least one temperature sensor arrangement 7 is in contact with the cylindrical body 3. The electrical control system 9 can then provide a control signal indicative of activation to the heating means 5. The heating means 5 is then configured to heat the cylindrical body 3 until the cylindrical body reaches a desired temperature of e.g. about 200 degrees Celsius.

In some embodiments the heating means 5 are configured to heat the cylindrical body 3 until they are deactivated e.g. by the electrical control system 9. In the embodiment illustrated in FIG. 4*b* the at least one temperature sensor arrangement 7 is not in contact with the cylindrical body 3. The electrical control system 9 can then provide a control signal indicative of deactivation to the heating means 5. The heating means 5 is then deactivated.

In some embodiments the electrical control system 9 is arranged to supply an electrical current i between the at least one temperature sensor arrangement 7 and the cylindrical body 3, thereby providing the electricity by means of which the degree of contact is detectable. The electrical control system 9 is then arranged to detect the degree of contact between the at least one temperature sensor arrangement 7 and the cylindrical body 3 by measurement of the electrical current i supplied.

In some embodiments the electrical control system 9 is arranged to feed the electrical current i into an electric circuit 15*a* formed by the at least one temperature sensor arrangement 7 and the cylindrical body 3. Such electrical current i can be an alternating current or a direct current. The electric circuit may also comprise electrical cables and necessary couplings. In some embodiments the electric circuit also comprises a low voltage supply system 25. The low voltage supply system 25 can be arranged to supply an alternating- or direct current into electrical circuits described herein. The electrical control system 9 can be arranged to detect the degree of contact between the at least one temperature sensor arrangement 7 and the cylindrical body 3 by measurement of the electrical impedance Z in the electrical circuit 15*a*.

Figure 4B:
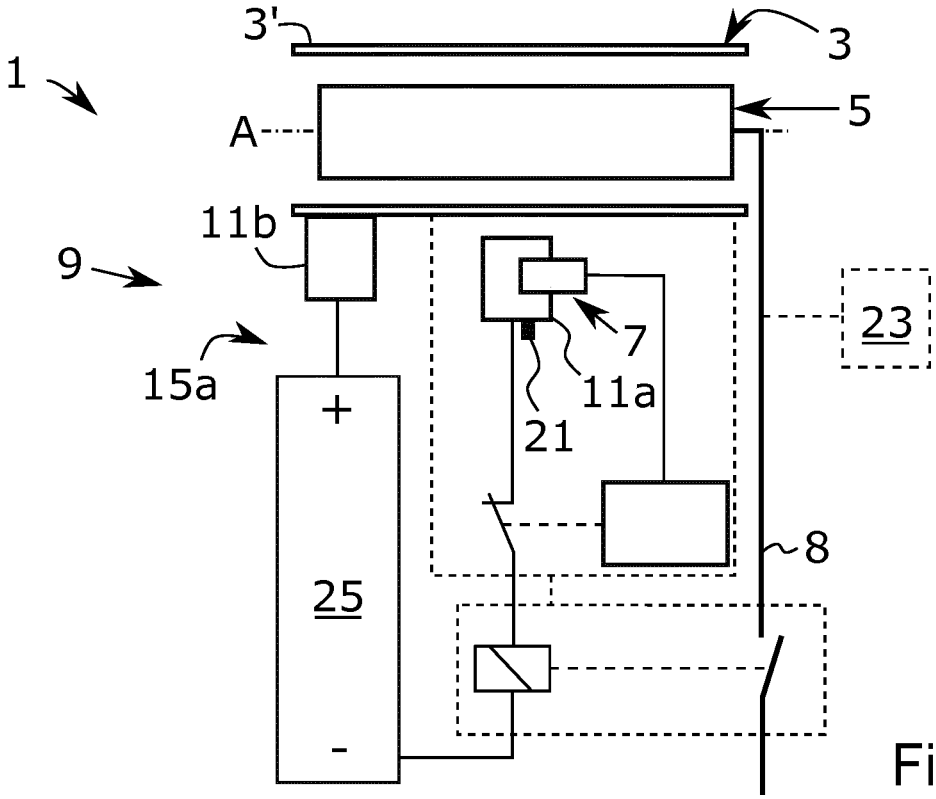

As illustrated in FIGS. 4*a* and 4*b* the temperature sensor arrangement 7 can comprise or be attached to a first electrically conductive friction shoe 11*a*. The electrical control system 9 illustrated in FIGS. 4*a* and 4*b* also comprise a second electrically conductive friction shoe 11*b*. As depicted in FIGS. 4*a* and 4*b* the ironing machine 1 may also comprise one or more resilient members 21. Such one or more resilient members 21 can bias at least one of the first and second friction shoes 11*a*, 11*b* towards the cylindrical body 3. An example of a resilient member is shown as an arm 210 in FIG. 2.

In the embodiment depicted in FIG. 4*a* the temperature sensor arrangement 7 with the friction shoe 11 is in contact with the peripheral surface 3' of the cylindrical body 3. Hereby electricity can be fed from the low voltage supply system 25 to the first electrically conductive friction shoe 11*a* via the second electrically conductive friction shoe 11*b* and the electrically conductive cylindrical body 3. The electricity can further be fed to a switch or similar which can be arranged to selectively connect or disconnect a heating means electric supply 8. Thus, when the temperature sensor arrangement 7 with the friction shoe 11 is in contact with the peripheral surface 3' of the cylindrical body 3 the electrical circuit 15*a* is closed and the heating means electric supply 8 is arranged to supply the heating means 5 with electricity.

In the scenario illustrated in FIG. 4*b* the temperature sensor arrangement 7 with the friction shoe 11 is no longer in contact or in less contact than a pre-set threshold value with the peripheral surface 3' of the cylindrical body 3. Hereby the electrical circuit 15*a* is cut off and the electrical supply to the heating means 5 is shut off. This is illustrated with the broken heating means electric supply 8 in FIG. 4*b*.

In some embodiments the ironing machine 1 comprises an alert system 23, illustrated in FIGS. 4*a* and 4*b*. The electric control system 9 can then be arranged to activate the alert system 23 when the impedance Z exceeds an alert threshold value.

Figure 5:
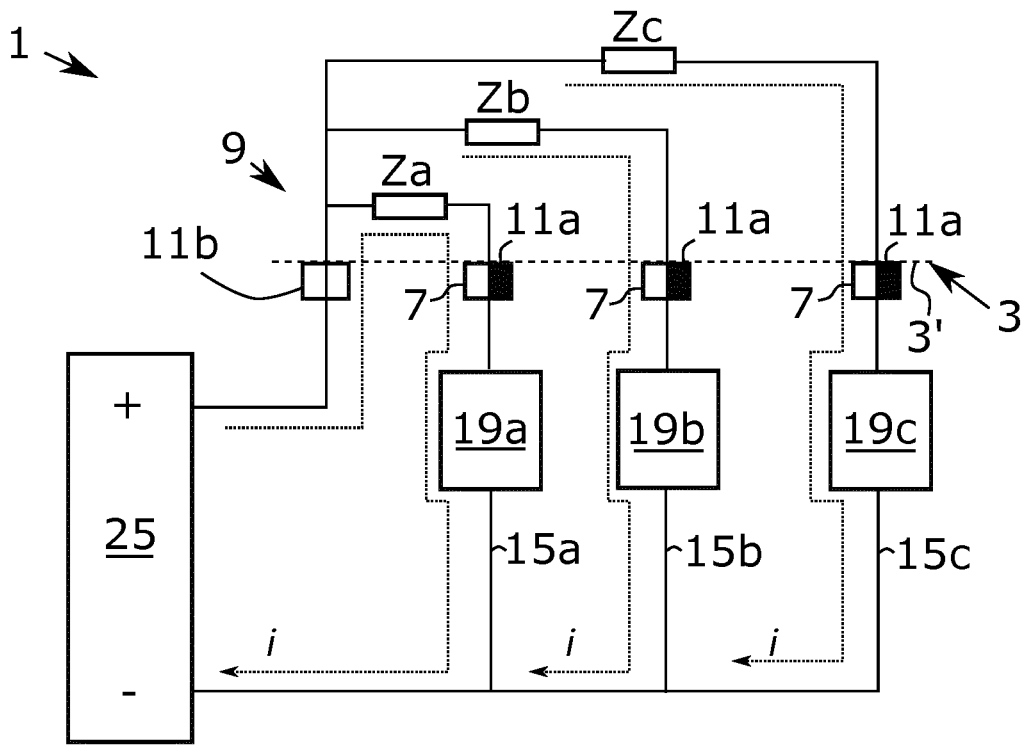
FIG. 5 illustrates a schematic view or the ironing machine according to some other embodiments.

In the embodiment illustrated in FIG. 5 the electrical control system 9 comprises three first electrically conductive friction shoes 11*a* and one second electrically conductive friction shoes 11*b*.

The electrical control system 9 is arranged to supply an electrical current i through the electric circuits 15*a*, 15*b*, 15*c* formed by the first electrically conductive friction shoes 11*a*, the second electrically conductive friction shoe 11*b* and the cylindrical body 3. The electrical control system 9 is further arranged to detect an electrical impedance Za, Zb, Zc in each electrical circuit 15*a*, 15*b* and 15*c*. The electrical impedance can for example be detected/measured between the second electrically conductive friction shoe 11*b* and each of the first electrically conductive friction shoes 11*a*. The electrical control system 9 can then generate a control signal indicative of the detected impedance Za, Zb, Zc, such that the heating means 5 can be controlled based on the control signal.

In the embodiment illustrated in FIG. 5 the electrical control system 9 comprise detection devices 19*a*, 19*b* and 19*c*. Any electrical control system 9 described herein can comprise one or more detection devices 19*a*, 19*b*, 19*c*. The detection devices 19*a*, 19*b*, 19*c* are arranged to detect an electrical current i and/or an impedance Z in the electrical circuit or any sub-circuits thereof.

Figure 6:
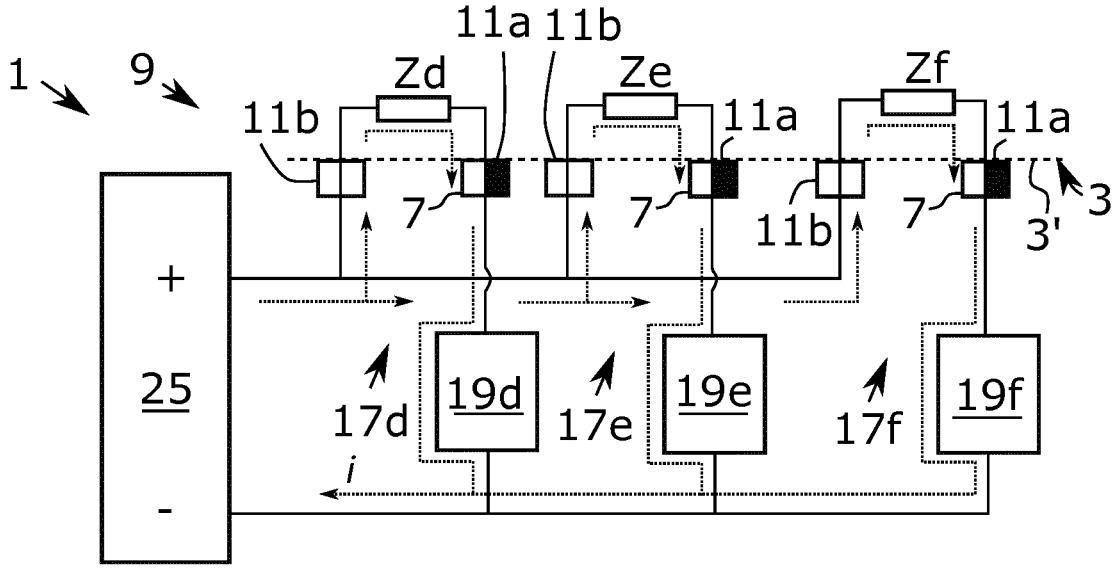
FIG. 6 illustrates a schematic view or the ironing machine according to some further embodiments.

FIG. 6 illustrates an embodiment in which the electrical control system 9 comprises three sub-circuits 17*d*, 17*e*, 17*f*. The electrical control system 9 may comprise any suitable number of sub-circuits. The number of sub-circuits can e.g. depend on a width of the cylindrical body 3. Each sub-circuit 17*d*, 17*e*, 17*f* comprises a first electrically conductive friction shoe 11*a*, a second electrically conductive friction shoe 11*b* and detection arrangements 19*d*, 19*e*, 19*f*.

The electrical control system 9 is arranged to supply an electrical current i through the cylindrical body 3 and each sub-circuit 17*d*, 17*e*, 17*f* and to detect, by the respective detection arrangements 19*d*, 19*e*, 19*f*, an electrical impedance Zd, Ze, Zf in each sub-circuit 17*d*, 17*e*, 17*f*. The electrical control system 9 can then generate a control signal indicative of the detected impedance Zd, Ze, Zf in each sub-circuit 17*d*, 17*e*, 17*f* such that the heating means 5 can be controlled based on the control signal.

The electrical circuits illustrated in FIGS. 4-6 are schematically illustrated. They can be arranged as direct current (DC) electrical circuits or alternating current (AC) electrical circuits. In a DC-circuit the impedance would be the same as the electrical resistance and can be detected and used for detecting the degree of contact between the cylindrical body 3 and the at least one temperature sensor arrangement 7. In an AC-circuit the electrical impedance can be detected and used for detecting the degree of contact between the cylindrical body 3 and the at least one temperature sensor arrangement 7.

The invention claimed is:

1. An ironing machine, comprising a cylindrical body which comprises a heater configured for heating of the cylindrical body and at least one temperature sensor, arranged to be in contact with the cylindrical body and to detect a temperature of the cylindrical body, wherein the at least one temperature sensor arrangement and the cylindrical body are at least partly made of electrically conductive material, and the ironing machine comprises an electrical control system configured to:

detect a degree of contact between the cylindrical body; and the at least one temperature sensor by means of electricity, and generate a control signal indicative of the detected degree of contact.

2. The ironing machine according to claim 1, wherein the electrical control system is arranged to;

supply an electrical current between the at least one temperature sensor and the cylindrical body, thereby providing the electricity by means of which the degree of contact is detectable, detect the degree of contact between the at least one temperature sensor and the cylindrical body by measurement of the electrical current.

3. The ironing machine according to claim 1, wherein the electrical control system is arranged to;

feed the electrical current into an electric circuit formed by the at least one temperature sensor and the cylindrical body, detect the degree of contact between the at least one temperature sensor and the cylindrical body by measurement of the electrical impedance.

4. The ironing machine according to claim 3, wherein the electric control system is arranged to deactivate the heater when the impedance exceeds a deactivation threshold value.

5. The ironing machine according to claim 3, wherein the ironing machine comprises an alert system, and wherein the electric control system is arranged to activate the alert system when the impedance exceeds an alert threshold value.

6. The ironing machine according to claim 3, wherein the electric circuit is an alternating current electrical circuit.

7. The ironing machine according to claim 1, wherein the temperature sensor comprises a first electrically conductive friction shoe.

8. The ironing machine according to claim 7, wherein the electrical control system comprises a plurality of first electrically conductive friction shoes one or more second electrically conductive friction shoes and the electrical control system is arranged to;

supply an electrical current through one or more electric circuits formed by the first electrically conductive friction shoes, the one or more second electrically conductive friction shoes and the cylindrical body, detect an electrical impedance in said electrical circuit, and generate a control signal indicative of the detected impedance.

9. The ironing machine according to claim 8, wherein the first and second friction shoes are arranged to be in contact with a peripheral surface of the cylindrical body.

10. The ironing machine according to claim 8, wherein the first and second friction shoes are distributed along a longitudinal direction of the cylindrical body.

11. The ironing machine according to claim 8, wherein the ironing machine comprises one or more resilient members arranged to bias at least one of the first and second friction shoes towards the cylindrical body.

12. The ironing machine according to claim 7, wherein the electrical control system comprises a plurality of sub-circuits, each sub-circuit comprising a first electrically conductive friction shoe, a second electrically conductive friction shoe and detection arrangements, and in that the electrical control system is arranged to;

supply an electrical current through the cylindrical body and each sub-circuit, detect, by the respective detection arrangements, an electrical impedance in each sub-circuit, and generate a control signal indicative of the detected impedance in each sub-circuit.

13. The ironing machine according to claim 1, wherein the electric control system is configured to set a level of heating for the heater based on the control signal.

14. The ironing machine according to claim 1, wherein the ironing machine comprises a low voltage supply system, arranged to be connected to the electrical control system.

15. The ironing machine according to claim 1, wherein the electrical control system is arranged to;

feed the electrical current into a direct current electric circuit formed by the at least one temperature sensor arrangement and the cylindrical body, detect the degree of contact between the at least one temperature sensor and the cylindrical body by measurement of electrical resistance in the direct current electrical circuit.

* * * * *